US010736367B2

(12) United States Patent
Woods

(10) Patent No.: US 10,736,367 B2
(45) Date of Patent: Aug. 11, 2020

(54) VENTILATION APPARATUS FOR PROTECTIVE VEST

(71) Applicant: Gareth Ambrose Woods, Chicago, IL (US)

(72) Inventor: Gareth Ambrose Woods, Chicago, IL (US)

( * ) Notice: Subject to any disclaimer, the term of this patent is extended or adjusted under 35 U.S.C. 154(b) by 58 days.

(21) Appl. No.: 15/732,188

(22) Filed: Sep. 28, 2017

(65) Prior Publication Data

US 2020/0046041 A1 Feb. 13, 2020

(51) Int. Cl.

| | |
|---|---|
| ***A41D 13/005*** | (2006.01) |
| ***A41D 27/28*** | (2006.01) |
| ***A41D 13/015*** | (2006.01) |
| *A41D 13/05* | (2006.01) |

(52) U.S. Cl.

CPC ..... *A41D 13/0158* (2013.01); *A41D 13/0053* (2013.01); *A41D 13/0155* (2013.01); *A41D 13/0518* (2013.01); *A41D 13/0556* (2013.01); *A41D 27/28* (2013.01)

(58) Field of Classification Search

CPC ..... A41D 13/0158; A41D 13/0053; A41D 13/0155; A41D 13/0518; A41D 13/0556; A41D 13/0025; A41D 27/28; B63C 9/1255

See application file for complete search history.

(56) References Cited

U.S. PATENT DOCUMENTS 5,303,425 A * 4/1994 Mele ..... A41D 13/0053 2/102
5,533,354 A * 7/1996 Pirkle ..... A41D 13/0053 2/458
5,884,372 A * 3/1999 Anscher ..... F16L 3/02 24/3.12
6,012,162 A * 1/2000 Bullat ..... A41D 13/018 2/2.5
6,260,201 B1 * 7/2001 Rankin ..... A41D 13/0025 2/272
6,349,412 B1 * 2/2002 Dean ..... A41D 13/0053 2/102
8,231,421 B1 * 7/2012 Hubbard ..... A41D 13/0125 441/92
9,359,049 B1 * 6/2016 Alexander ..... B63C 9/115
9,591,911 B2 * 3/2017 Hopmeier ..... A45F 3/16
9,955,740 B2 * 5/2018 Bruce ..... A41D 1/04
2005/0221701 A1 * 10/2005 Smith ..... B63C 9/1255 441/106
2012/0233749 A1 * 9/2012 Tymofy ..... A41B 9/06 2/456
2015/0327602 A1 * 11/2015 Nelson ..... F24F 3/1411 2/102
2016/0270728 A1 * 9/2016 McGinnis ..... A41D 13/0007
2017/0181482 A1 * 6/2017 Bruce ..... A41D 1/04
2017/0295860 A1 * 10/2017 Hall ..... F04B 45/00

* cited by examiner

*Primary Examiner* — Christopher R Harmon
(74) *Attorney, Agent, or Firm* — Nixon Peabody LLP

(57) ABSTRACT

An apparatus having a plurality of inflatable members, the inflatable members worn in a vertical orientation on a human torso; a collar portion connected to the plurality of inflatable members; and at least one inflation tube connected to the plurality of inflatable members, wherein the inflation tube includes a mouthpiece and a valve to controllably inflate and deflate inflatable members in the plurality. The apparatus is worn by a person underneath a protective vest to provide ventilation of body heat between the person and the protective vest.

13 Claims, 9 Drawing Sheets

VENTILATION APPARATUS FOR PROTECTIVE VEST

FIELD OF THE INVENTION

The present invention relates broadly to protective vests, and more specifically to bulletproof vests worn by law enforcement.

BACKGROUND OF THE INVENTION

Law enforcement and military personnel have always faced life-threatening risks in the performance of their duties. The danger of being on the receiving end of deadly force is especially high for members of law enforcement, because their job brings them in extremely close proximity to armed individuals who will fire weapons at close range at police officers, sometimes without warning and sometimes before a police officer is aware of the danger. The risk to police officers is extremely high when performing traffic stops, responding to domestic disturbance calls, or when confronting an individual under the influence of drugs or alcohol, or while apprehending a criminal suspect.

To provide a significant degree of protection, many police departments require their officers to wear protective vests over their torsos that are designed to stop bullets from entering the body. Various improvements have been made over the last 70 years from the bulky flak jackets that military personnel used during World War II, utilizing lighter-weight materials that have proven to effectively stop the majority of bullets that are sold today. However, one significant problem remains unsolved: heat.

During the winter months, when temperatures are low, wearing a protective vest doesn't pose a significant risk of causing the wearer to overheat. But during summer months, when temperatures and humidity can be stifling, wearing a protective vest places a significant risk of overheating on the wearer. The wearer's core temperature can rise quickly and become an enormous distraction at a time when the wearer needs to focus attention on his or her immediate surroundings, not their own discomfort. Being distracted instead of focusing on potentially deadly threats can easily result in death or serious injury, as a protective vest does not provide absolute protection to the wearer. For example, the best quality protective vest does not protect a person's head, throat, or main arteries in the lower abdomen and legs. If the wearer is more focused on their discomfort, they may miss the opportunity to protect themselves from a deadly attack.

SUMMARY OF THE INVENTION

The present invention solves the problems described above by providing an apparatus that controllably lifts a portion of a protective vest away from the wearer's body, thus allowing body heat to escape from the areas of the body that are not in contact with the vest. The vest still is worn during operation of the apparatus of the present invention, so no protection from the vest is lost.

In one aspect, the present invention provides an apparatus having: a plurality of inflatable members, the inflatable members worn in a vertical orientation on a human torso; a collar portion connected to the plurality of inflatable members; and at least one inflation tube connected to the plurality of inflatable members, wherein the inflation tube includes a mouthpiece and a valve to controllably inflate and deflate inflatable members in the plurality. In an embodiment, a first pair of inflatable members is located on the front of the human torso. In an embodiment, a second pair of inflatable members is located on the back of the human torso. In an embodiment, the at least one inflation tube is retained on the collar portion. In an embodiment, the at least one inflation tube is retained by clips. In an embodiment, the at least one inflation tube is retained by hook-and-loop fasteners.

In another aspect, the present invention provides an apparatus, having: a plurality of inflatable members, the inflatable members worn in a vertical orientation on a human torso and filled with a cooling material; and a collar portion connected to the plurality of inflatable members. In an embodiment, the cooling material is water. In an embodiment, the cooling material is ice. In an embodiment, the cooling material is a heat absorbing, non-water material.

DETAILED DESCRIPTION OF THE PREFERRED EMBODIMENT OF THE PRESENT INVENTION

Figure 1C:
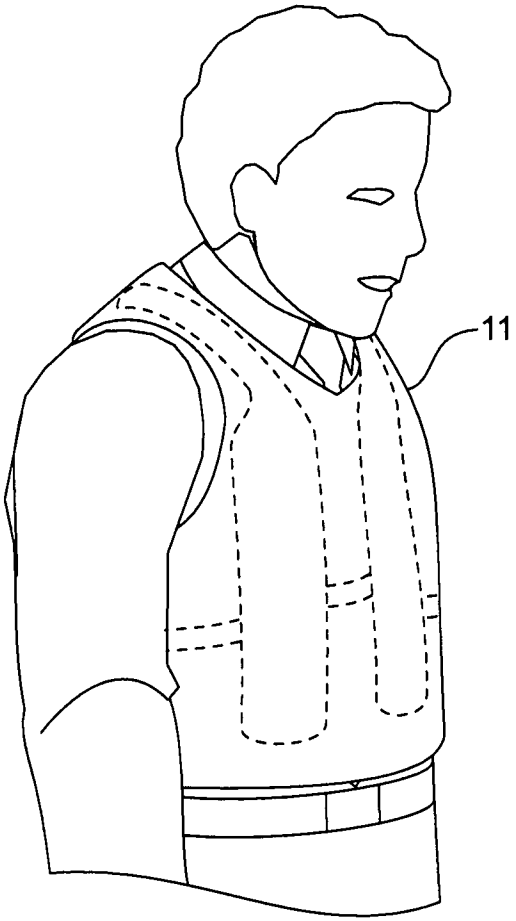
FIGS. 1A-1C show how the apparatus of the present invention is worn under a protective vest.
Figure 1B:
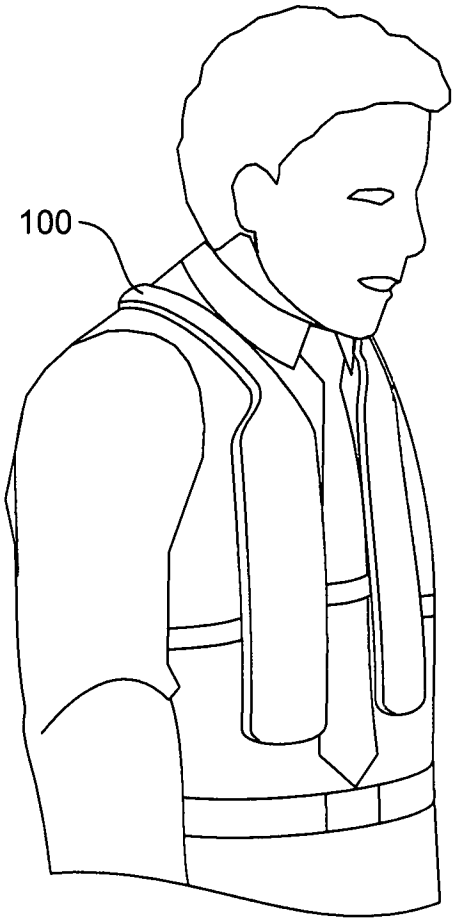
Figure 1A:
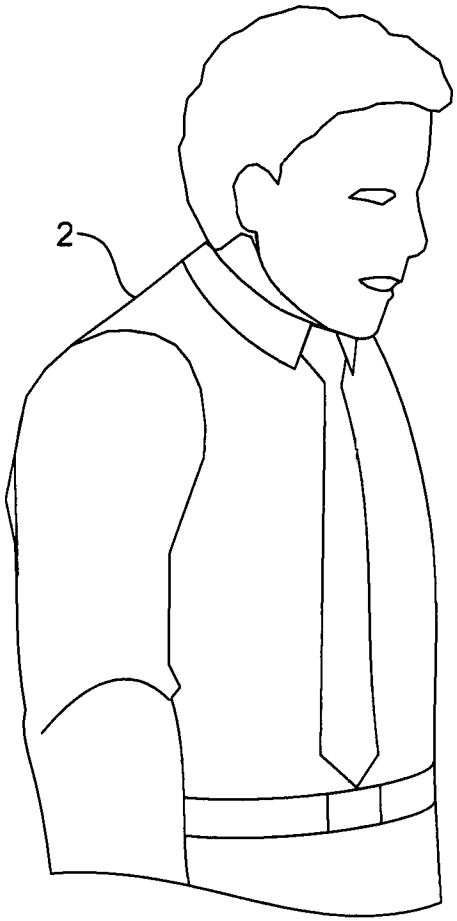
Figure 2:
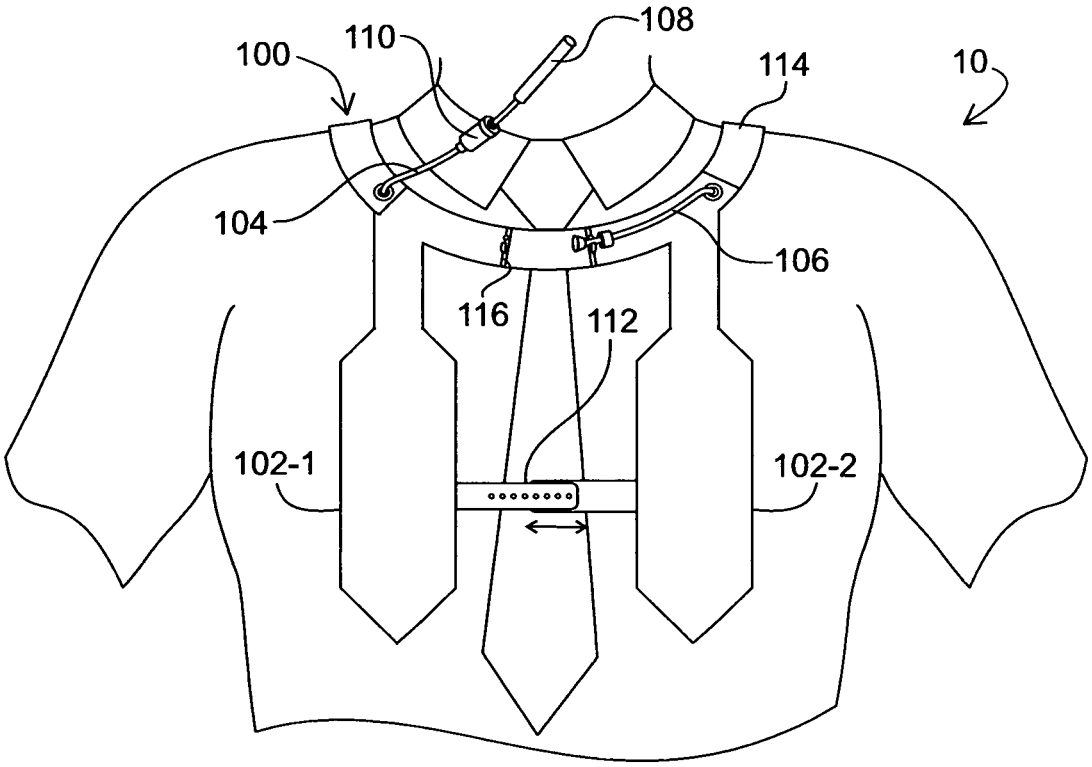
FIG. 2 shows an elevation view of a person wearing the apparatus of the present invention as viewed from in front of the person.

Directing attention to FIGS. 1A-1C, the present invention is shown as a ventilation apparatus 100 worn over shirt 2 and under protective vest 11. As shown in FIG. 2, person 10 is wearing ventilation apparatus 100 that is suspended over the shoulders of person 10. Ventilation apparatus 100 comprises a plurality of inflatable members 102 disposed in a vertical orientation along person 10's upper body. As shown, it is anticipated that ventilation apparatus 100 is placed over the uniform of person 10, and then the protective vest (not shown) is placed over ventilation apparatus 100. When inflatable members 102 are inflated with air, as shown in FIG. 3, inflatable members have a depth to them that prevents the protective vest from making full contact with the person's torso, so that the material of the protective vest does not trap body heat within person 10, thus providing a degree of ventilation between the protective vest and the body of person 10.

Figure 3:
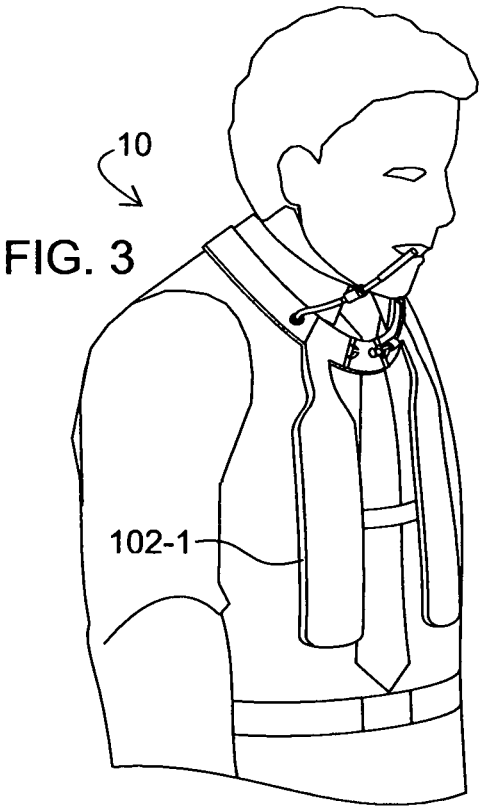
FIG. 3 shows a perspective view of the person shown in FIG. 2 wearing the apparatus of the present invention as viewed from the side of the person and slightly in front of the person.
Figure 4:
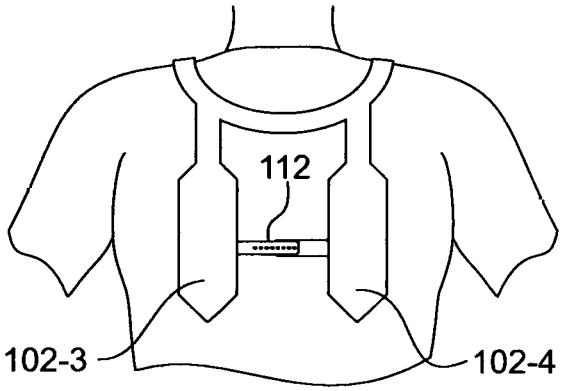
FIG. 4 shows an elevation view of the person shown in FIGS. 2 and 3 wearing the apparatus of the present invention as viewed from behind the person.

Also shown in FIGS. 2 and 3 are inflation tubes 104 and 106. Inflation tube 104 controllably inflates and deflates inflatable members 102-1 and 102-2 on the front of person 10, and inflation tube 104 controllably inflates and deflates inflatable members 102-3 and 102-4, worn on the back of person 10 as shown in FIG. 4. As shown, inflation tubes 104 and 106 include a mouthpiece 108 and valve 110. When valve 110 is open, person 10 can blow into mouthpiece 108, thus inflating inflatable members 102. Once inflated, person 10 closes valve 110. To deflate inflatable members 102, person 10 opens valve 110.

In an embodiment, separate mouthpieces 108 and valves 110 are used to separate inflatable members 102 worn on the back of person 10 from inflatable members 102 worn on the front of person 10 so that person 10 can ride in a vehicle comfortably, with inflatable members 102-3 and 102-4 deflated while inflatable members 102-1 and 102-2 remain inflated on the chest of person 10.

To maintain inflatable members 102 in a vertical orientation, a two-part positioning member 112 can be included between inflatable members 102-1 and 102-2 on the front of person 10 as well as between inflatable members 102-3 and 102-4 on the back of person 10. Two-part positioning member can be a semi-rigid material, such as flexible strap made from plastic or other suitable material, that maintains a desired distance between inflatable members 102-1 and 102-2 or 102-3 and 102-4. A plurality of locking positions can be included by placing a series of apertures on one part of positioning member 112 and a fastener on the other part of positioning member 112, so that different body sizes and shapes can be accommodated while maintaining inflatable members 102 in an optimal, vertical orientation for maximum ventilation.

Figure 5:
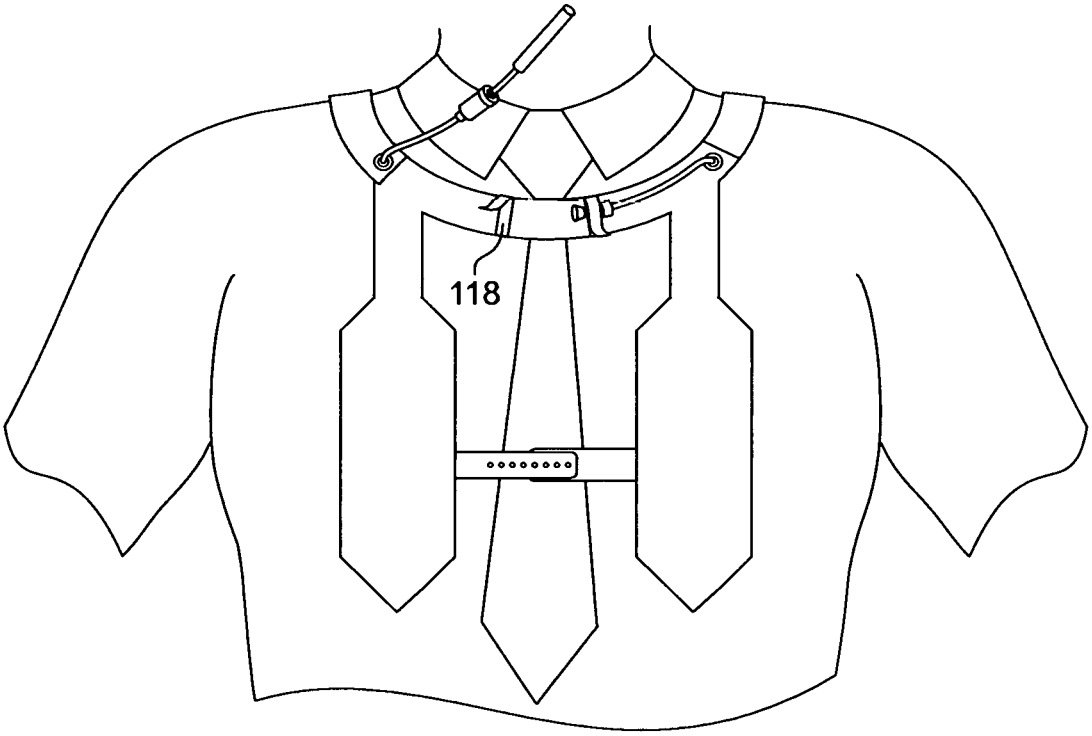
FIG. 5 shows an elevation view of an alternative embodiment of the apparatus of the present invention with hook-and-loop fasteners instead of retaining clips.

Returning to FIG. 2, inflation tubes 104 and 106 are retained on the annular or collar portion 114 of ventilation apparatus. Collar portion 114 includes retaining clips 116, which secure inflation tubes 104 and 106 when not in use. As shown in FIG. 5, in an alternative embodiment, hook and loop fasteners 118, such as marketed under the Velcro™ brand, can be used in place rigid retaining clips 116.

Figure 6:
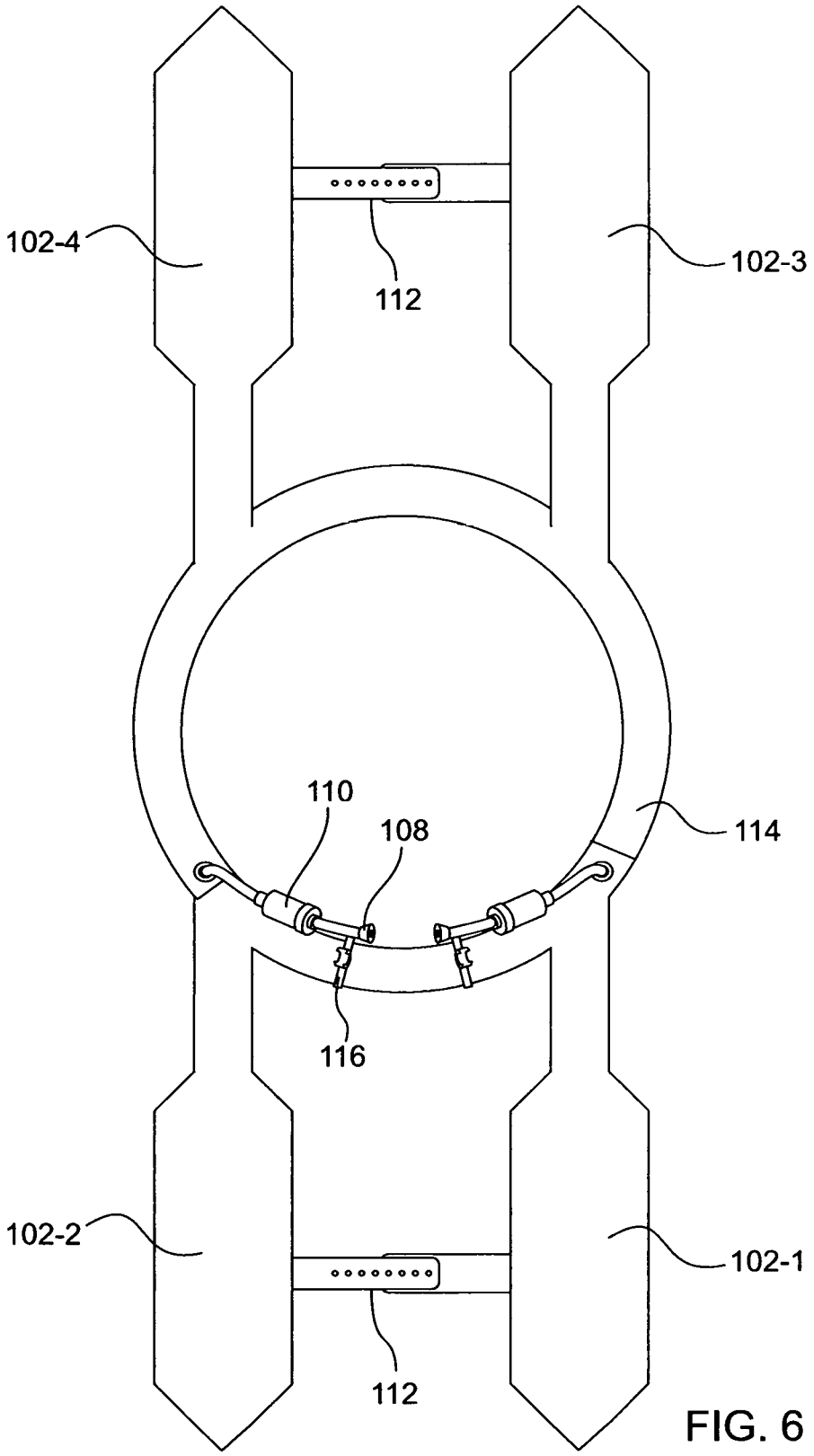
FIG. 6 shows a plan view of the apparatus of the present invention only, without being worn by a person.

Directing attention to FIG. 6, ventilation apparatus 100 is shown in a plan view. This view shows ventilation apparatus 100 in a preconfigured orientation, with positioning members 112 adjusted to accommodate person 10. Once adjusted to fit a particular individual, it is anticipated that ventilation apparatus 100 doesn't need additional adjustment, and can simply be lifted on and off person 10 as needed. The simplicity and ease of use of ventilation apparatus 10 encourages its usage, as it will only take a moment to place it on one's body and inflate as needed. There are no moving parts, no power source required, and person 10 can simply use his or her lungs to fill inflatable members 102 as desired.

While the present invention preferably uses the breath of person 10 to inflate inflatable members 102, it is possible to fill inflatable members with liquid and freeze them, to provide additional cooling properties. Similarly, cool water can be used if ice is too uncomfortable. In a different embodiment, heat-absorbing liquid such as antifreeze may be used to fill inflatable members 102.

Figure 7:
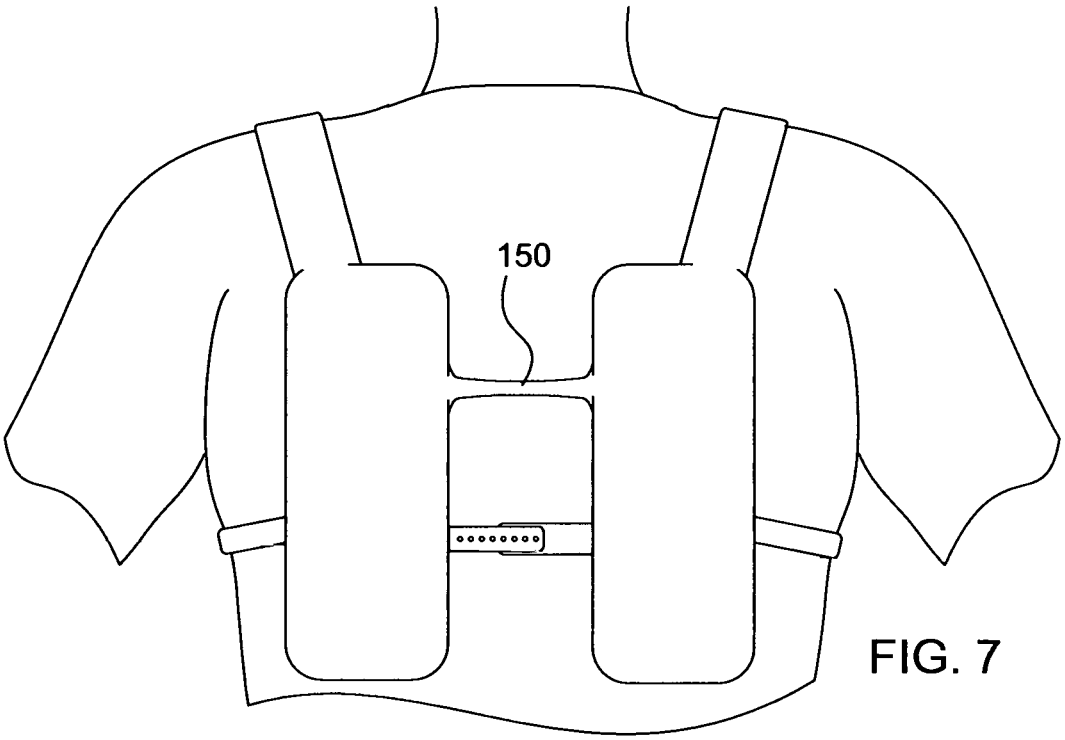
FIGS. 7-8 show an alternative embodiment of the present invention with an air bridging path on the back of the apparatus and an inflation pump on the front.
Figure 8:
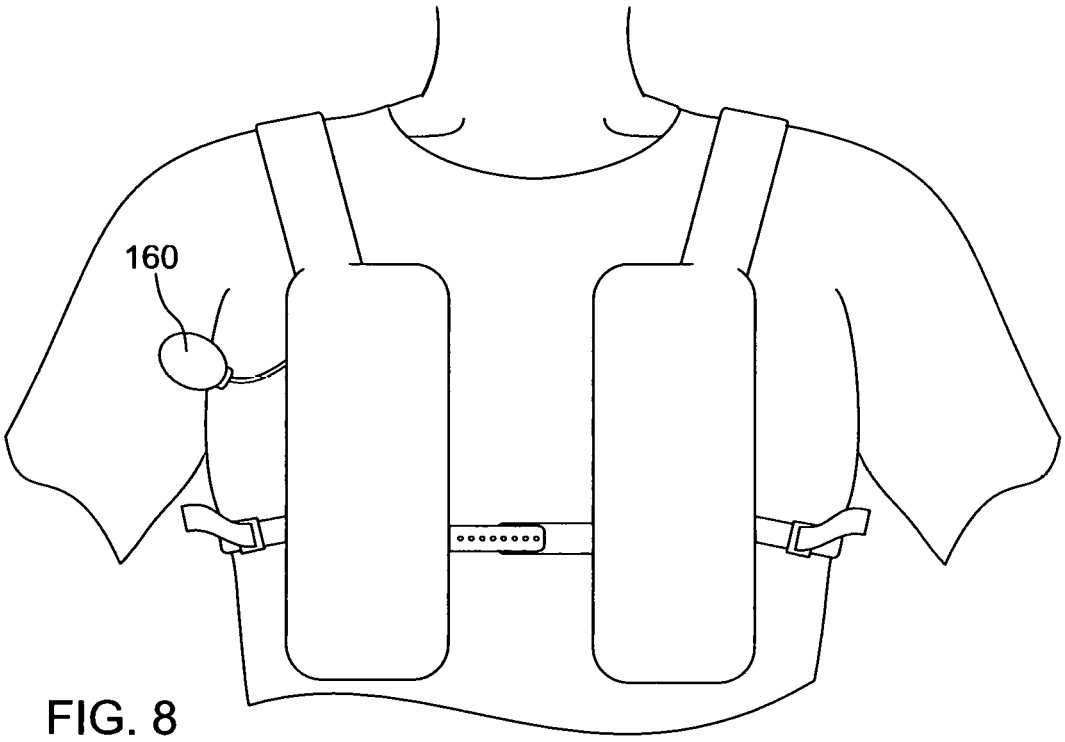

Directing attention to FIG. 7, inflatable members can also incorporate an air-bridging path 150 between a pair of inflatable members. As shown in FIG. 8, a hand-squeeze air pump 160 can be used in place of an inflation tube. This is particularly useful with the air-bridging path 150.

Figure 9:
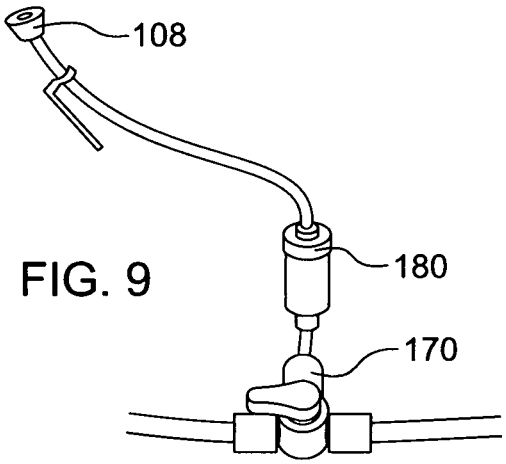
FIG. 9 shows a three-way valve and filter used to inflate embodiments of the present invention with a mouthpiece.
Figure 10:
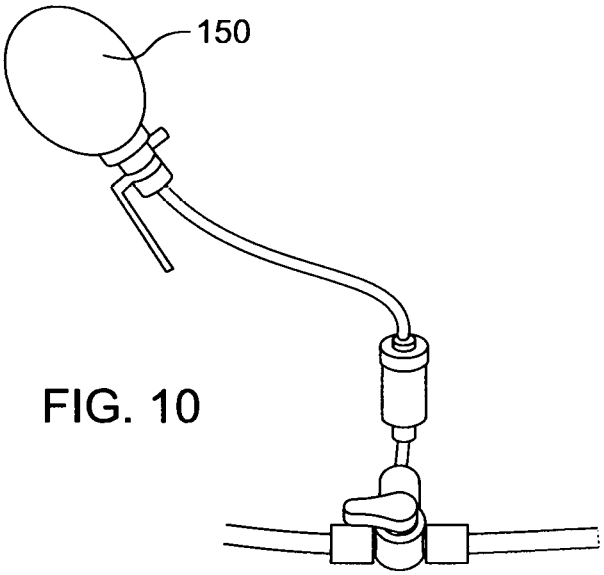
FIG. 10 shows a hand pump connected to the three-way valve of FIG. 9.
Figure 11:
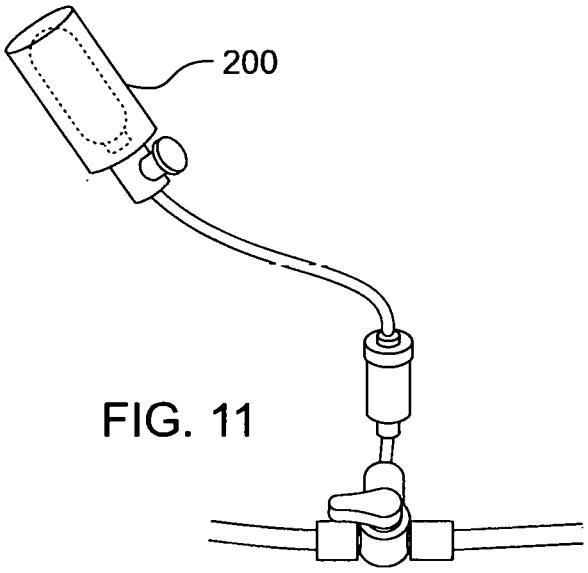
FIG. 11 shows a cartridge of compressed gas connected to the three-way valve and filter shown in FIG. 9.

FIGS. 9-11 show a three-way directional valve 170 that can controllably direct inflation to particular inflation members depending on orientation of the valve switch. A filter 180 can also be incorporated with inflation tubes, and can be placed in line with mouthpiece 108, hand pump 150, or compressed gas cartridge 200. Also, detachable CO2 pumps, such as the CO2 Inflator, available on Amazon.com from Pro Bike Tool, can be utilized with inflation members. In an embodiment, inflation tubes can be implemented lower on the body, with valves that accept a CO2 pump for easy inflation. In yet another embodiment, magnetic fasteners can be utilized with the valves that accept the CO2 pump to hold the inflation members in place on the person's body just as fabric straps would.

Figure 12:
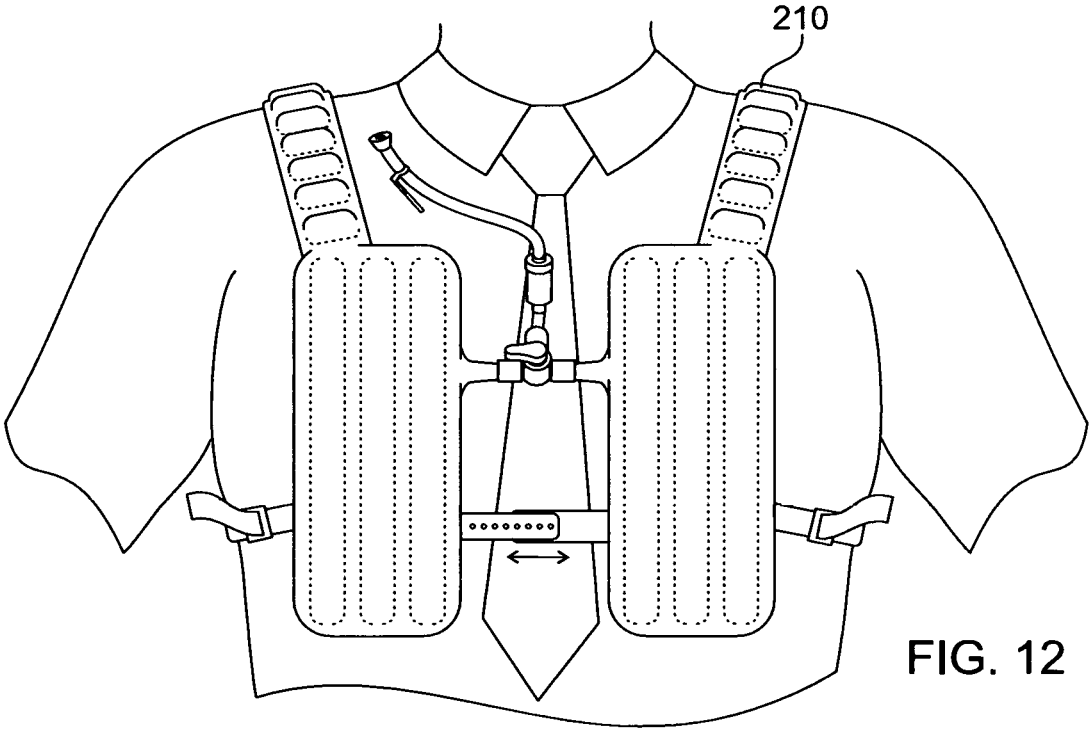
FIGS. 12 and 13 show an alternative embodiment of multiple air channels disposed on shoulder straps.
Figure 13:
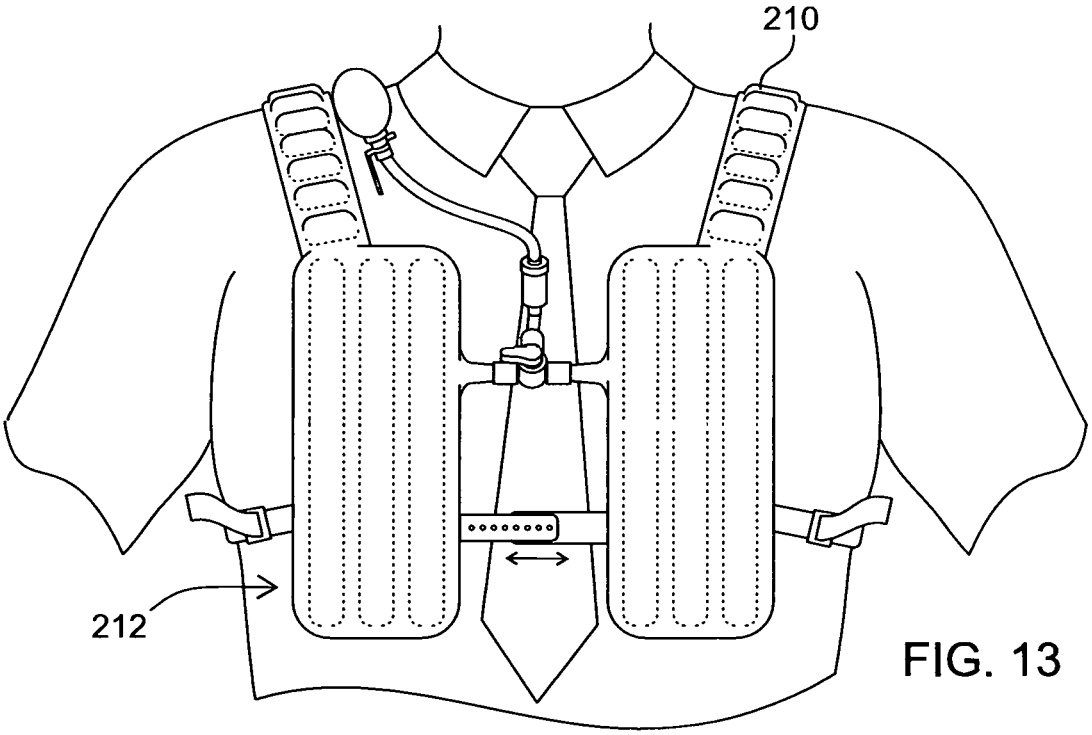

Directing attention to FIG. 12, yet another alternative embodiment is shown. Shoulder straps 210 can incorporate pockets that can be inflated or liquid filled and/or frozen for additional cooling, again using mouthpiece or pump inflation devices. Also as shown in FIGS. 12 and 13, each inflation member can have multiple inflation pockets 212.

Figure 14:
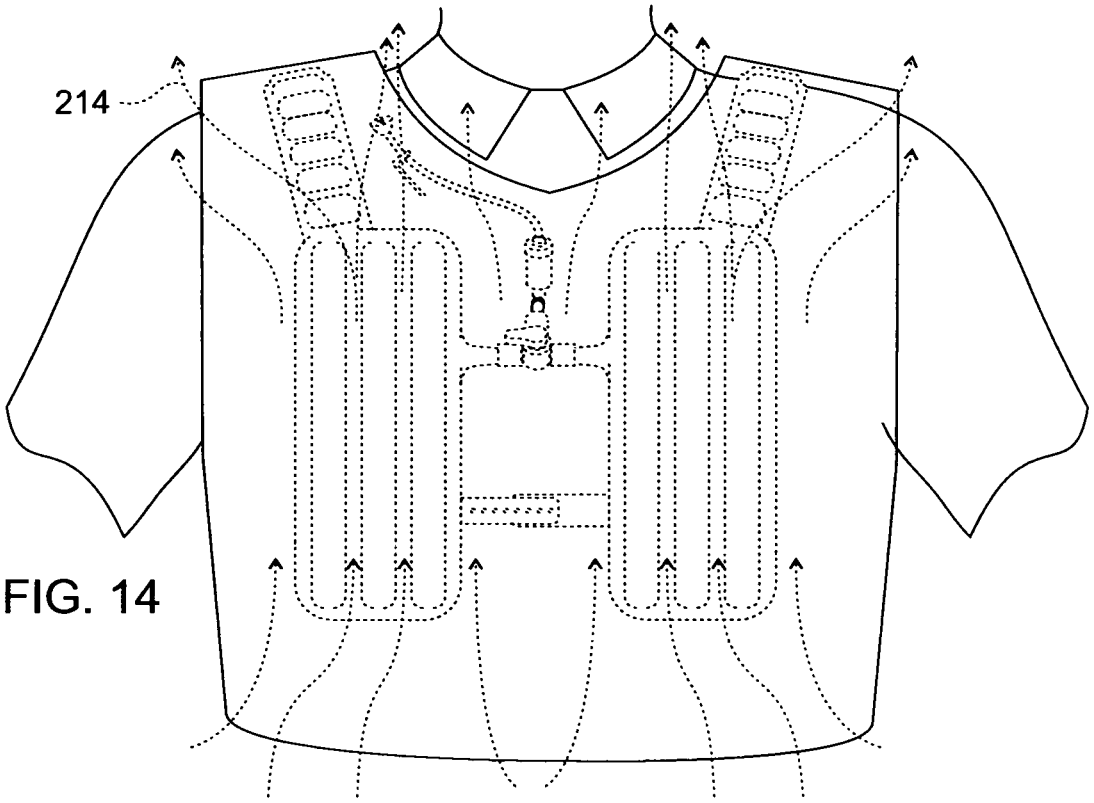
FIG. 14 shows ventilation paths for the embodiment shown in FIGS. 12 and 13.

FIG. 14 shows directional air flow provided by inflatable members of the various embodiments. As shown, directional arrows 214 generally indicate the paths that air travels along the body and eventually escaping above the protective vest and carrying heat with it.

Figure 15:
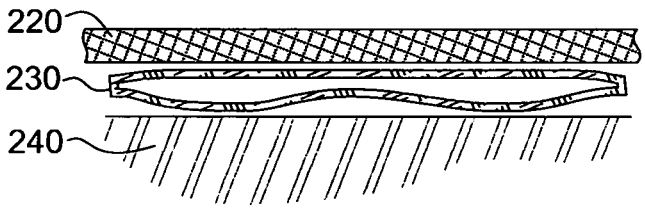
FIG. 15 shows a cross sectional view before inflation.
Figure 16:
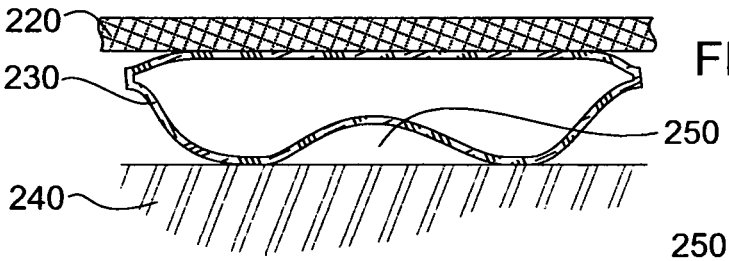
FIG. 16 shows the cross sectional view of FIG. 15 during inflation.
Figure 17:
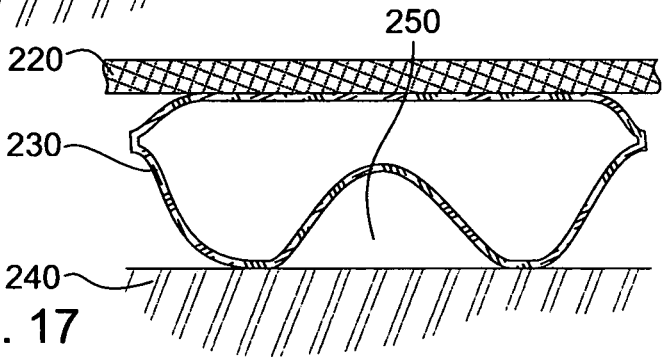
FIG. 17 shows the cross sectional view of FIG. 15 fully inflated.
Figure 18:
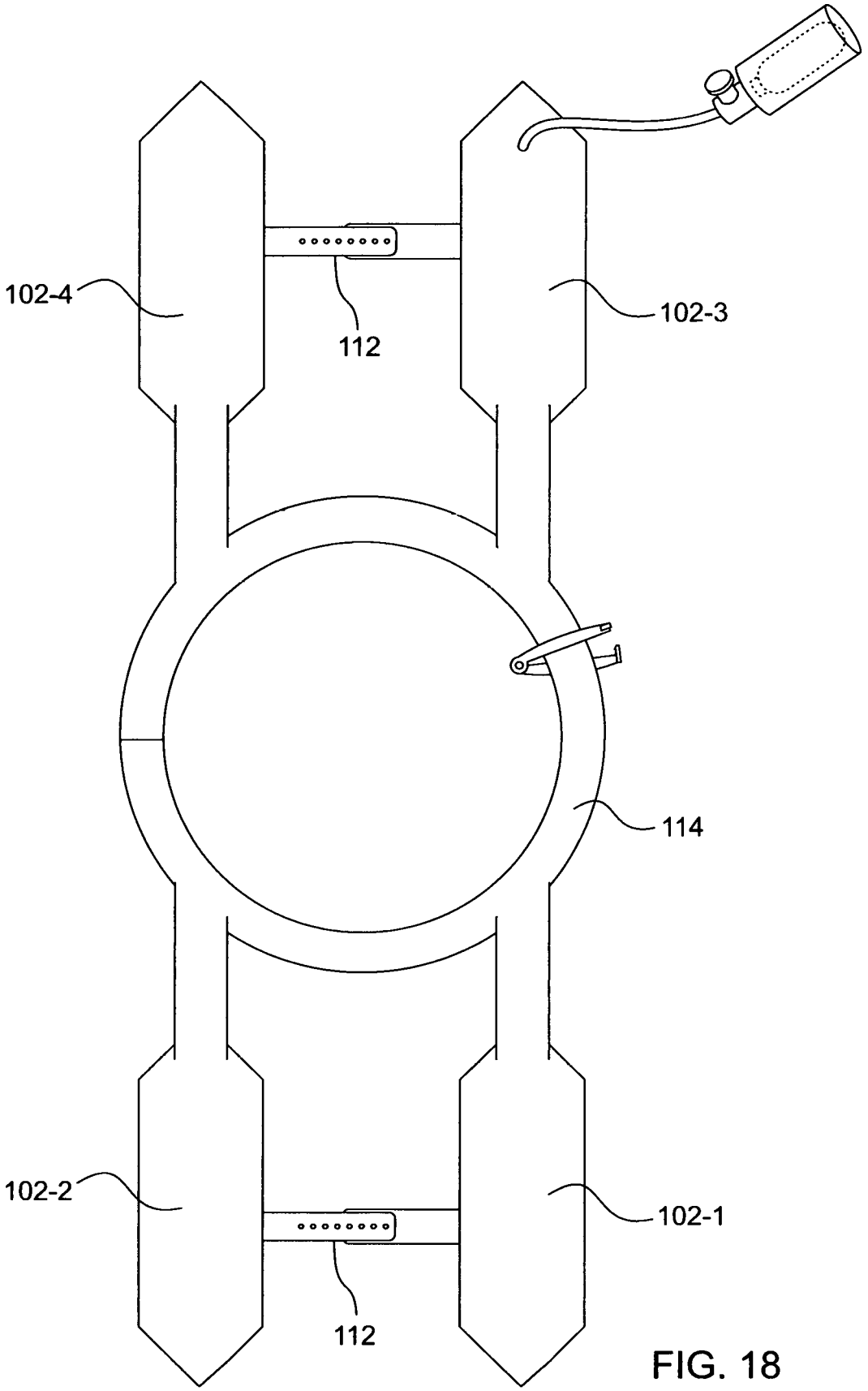

FIGS. 15-17 show the various states of inflation and thus the adjacent cooling paths. As shown in FIG. 15, vest 220 is in contact with inflatable member 230 in a deflated state, in contact with vest 220 and wearer's body 240. In FIG. 16, inflatable member 230 is half-inflated, showing an air channel 250. In FIG. 17, air channel 250 is more pronounced.

With the increased cooling of a person that the ventilation apparatus of the present invention provides by providing a space between his or her body and a protective vest, the wearer is more comfortable and can focus his or her attention on the immediate surroundings and provide better protection for himself or herself, as well as more attention on the people they are sworn to protect.

While a ventilation apparatus with inflatable members for use with a protective vest has been illustrated and described in the best mode of the preferred embodiment, it is to be understood that numerous changes and modifications can be made to embodiments of the present invention without departing from the spirit thereof.

What is claimed is:

1. A cooling device configured to lift a portion of a protective vest away from a body of a wearer of the protective vest, the cooling device comprising:

an inflatable collar configured to be placed around a neck of the body of the wearer, the inflatable collar being generally circular in shape and including a first section and a second section;

a plurality of front inflatable members extending from the first section of the inflatable collar;

a plurality of rear inflatable members extending from the second section of the inflatable collar;

a first inflation tube coupled to the first section of the inflatable collar and configured to controllably carry a first portion of a substance to inflate and deflate the plurality of front inflatable members and the first section of the inflatable collar; and a second inflation tube coupled to the second section of the inflatable collar and configured to controllably carry a second portion of the substance to inflate and deflate the plurality of rear inflatable members and the second section of the inflatable collar, wherein the first section of the inflatable collar and the second section of the inflatable collar are independently inflatable such that the plurality of rear inflatable members is separately inflatable from the plurality of front inflatable members via the second inflation tube.

2. The cooling device of claim 1, wherein the plurality of front inflatable members is a pair of generally rectangular inflatable members configured to be worn on the front of the wearer of the protective vest and hanging downward from the first section of the inflatable collar.

3. The cooling device of claim 1, wherein the plurality of rear inflatable members is a pair of generally rectangular inflatable members configured to be worn on the back of the wearer of the protective vest and hanging downward from the second section of the inflatable collar.

4. The cooling device of claim 1, further comprising:

a first retainer configured to retain the first inflation tube on the inflatable collar of the cooling device; and a second retainer configured to retain the second inflation tube on the inflatable collar of the cooling device.

5. The cooling device of claim 4, wherein at least one of the first and second retainers is a retaining clip.

6. The cooling device of claim 4, wherein at least one of the first and second retainers is a hook-and-loop fastener.

7. The cooling device of claim 4, wherein first and second retainers are coupled to the inflatable collar of the cooling device on a same side as the plurality of front inflatable members.

8. The cooling device of claim 1, further comprising a horizontal inflatable air bridge, wherein a first inflatable member of the plurality of rear inflatable members is coupled to a second inflatable member of the plurality of rear inflatable members via the horizontal inflatable air bridge.

9. The cooling device of claim 1, wherein the substance to inflate and deflate the plurality of front inflatable members includes a cooling material.

10. The cooling device of claim 9, wherein the cooling material is water.

11. The cooling device of claim 9, wherein the cooling material is antifreeze.

12. The cooling device of claim 1, wherein each of the plurality of front inflatable members includes a plurality of horizontal inflatable pockets arranged in parallel to one another, each of the plurality of horizontal inflatable pockets being substantially rectangular in shape.

13. The cooling device of claim 1, further comprising a pair of shoulder straps, at least a portion of the pair of shoulder straps forming the inflatable collar of the cooling device, wherein each of the pair of shoulder straps includes a plurality of air channels arranged in parallel to one another.

* * * * *